US007907873B2

(12) United States Patent
Sandler et al.

(10) Patent No.: US 7,907,873 B2
(45) Date of Patent: Mar. 15, 2011

(54) SYSTEM AND METHOD FOR ADJUSTING INK DRYING LEVEL DURING A PRINTING PROCESS

(75) Inventors: Mark Sandler, Rehovot (IL); Shai Lior, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 169 days.

(21) Appl. No.: 12/257,711

(22) Filed: Oct. 24, 2008

(65) Prior Publication Data

US 2009/0263163 A1 Oct. 22, 2009

Related U.S. Application Data

(60) Provisional application No. 61/046,272, filed on Apr. 18, 2008.

(51) Int. Cl.
*G03G 15/10* (2006.01)
*G03G 15/11* (2006.01)

(52) U.S. Cl. ..... 399/251; 399/249

(58) Field of Classification Search ..... 399/249, 399/251; 430/117.3; 347/102
See application file for complete search history.

(56) References Cited

U.S. PATENT DOCUMENTS

| | | | | |
|---|---|---|---|---|
| 5,157,443 | A | 10/1992 | Anderson et al. | |
| 5,447,566 | A | 9/1995 | Loiacono | |
| 5,652,080 | A * | 7/1997 | Yoshino et al. | 430/117.3 X |
| 6,363,234 | B2 * | 3/2002 | Landa et al. | 399/249 |
| 6,382,850 | B1 | 5/2002 | Freund et al. | |
| 6,608,982 | B2 * | 8/2003 | Shin et al. | 399/251 |
| 6,650,857 | B2 * | 11/2003 | Nukada et al. | 399/249 |
| 6,692,189 | B2 | 2/2004 | Anderson et al. | |
| 6,719,423 | B2 | 4/2004 | Chowdry et al. | |
| 6,932,469 | B2 | 8/2005 | May et al. | |
| 6,934,480 | B2 * | 8/2005 | Shim et al. | 399/49 |
| 7,052,124 | B2 | 5/2006 | Pcikup | |
| 7,139,515 | B2 * | 11/2006 | Yamamoto et al. | 399/251 |
| 2007/0140737 | A1 | 6/2007 | Takano et al. | |

* cited by examiner

*Primary Examiner* — Sandra L Brase

(57) ABSTRACT

A system for adjusting air supply applied to evaporate carrier liquid during a one shot process printing job, comprises at least one air supply unit, at least one air knife unit configured for directing air toward at least a separation of the image, wherein each separation includes a single color of a plurality of colors used to form the full colored image, and controller configured for adjusting at least one air supply parameter between separations.

20 Claims, 9 Drawing Sheets

SYSTEM AND METHOD FOR ADJUSTING INK DRYING LEVEL DURING A PRINTING PROCESS

CROSS-REFERENCE TO RELATED PATENT APPLICATIONS

This application claims the benefit of U.S. provisional patent application Ser. No. 61/046,272, filed on Apr. 18, 2008, entitled "SYSTEM AND METHOD FOR ADJUSTING INK DRYING LEVEL DURING A PRINTING PROCESS".

BACKGROUND OF THE INVENTION

Various methods of electro-photographic printing are well known. In some methods, a photoconductive surface is charged to a uniform potential and then selectively discharged to record an electrostatic latent image. The latent image is developed with liquid toner composed of toner particles dispersed in a carrier liquid, e.g. imaging oil. The developed image is transferred to an intermediate transfer member (ITM) such as a blanket and then transferred to a substrate, e.g. paper. Transfer of the developed image is typically referred to as the first transfer while transfer from the ITM to the substrate is typically referred as the second transfer.

The ITM is typically heated to improve transferability of the developed image. For slow speed systems, the ITM may operate without any drying systems. In these systems the heat of the ITM dries the image and removes some of the liquid carrier in the image, to improve the transfer of the image to the substrate. For some systems, liquid is alternatively or additionally removed prior to transfer of the image to the ITM, e.g. before the first transfer.

For high speed imaging, a dryer may be used to dry the image on the ITM. Typically, the dryer includes fans connected to air knives along the ITM circumference that blow air towards the printed image on the blanket. Typically drying is applied after the first transfer and before the second transfer. The air facilitates removing carrier liquid, e.g. by evaporation, for drying the image prior to transferring to the desired substrate.

There are typically two process methods for transferring a colored image from the photoreceptor to the substrate. One method is a multi-shot process method in which, each printed separation, e.g. each color, is transferred separately from the blanket to the substrate, until a full image is achieved. This process is typically used for sheet fed presses. A second method is a one shot process in which all printed color separations are first acquired on the blanket and only then transferred in one pass from the blanket to the substrate.

DESCRIPTION OF SPECIFIC EMBODIMENTS OF THE INVENTION

Figure 1:
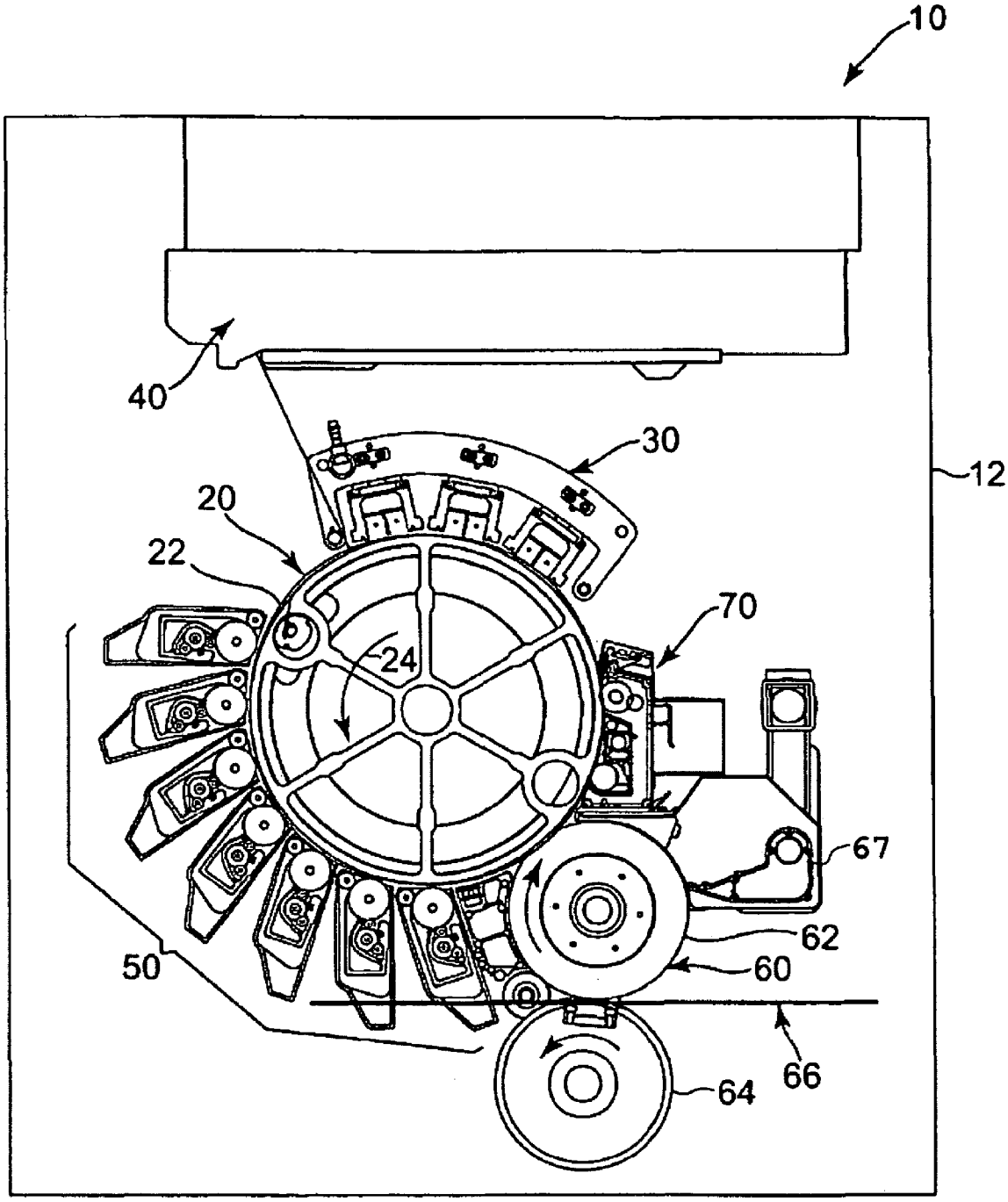
FIG. 1 is an exemplary schematic illustration of a liquid electro-photography printing device that may include a ventilation system and method according to some embodiments of the present invention.

The present invention, in some embodiments thereof relates to liquid electro-photography printing devices and more particularly but not exclusively to ventilation systems for ink drying in liquid electro-photography printing devices.

The present inventors have found that the amount of imaging oil that may reach a blanket surface with ink can vary significantly based on the percent coverage of each separation. In addition, the amount of drying required may vary significantly based on the absorbency of the substrate used. In some known systems, null separations, e.g. non printed cycles, are added in order to increasing the drying level when heavy images, e.g. large percent coverage, are printed and/or for images printed on relatively non-absorbent substrates.

The amount of imaging oil on the ITM during the second transfer, directly affects the quality of the image printed on the substrate. For example, image over drying may lead to improper small dot transfer, while image under drying may lead to wetness and/or cracks on the printed image. Improper drying may result in printed job rejection and/or failure of the blanket.

In one shot process printing, an image including multiple separations and/or color layers is acquired on the blanket and transferred in one pass to the substrate. Typically, a dryer is applied to dry the images as the separations are acquired. Typically, dryers are applied during the entire printing process. Some times null cycles are added to further dry the image, e.g. one or more null cycle depending on the printing parameters. Adding null cycles to a printing job leads to longer a printing time and wasteful use of the printer which is undesirable. The inventors have found that as the ITM completes first transfer of all the separations and/or prior to the second transfer, the first separations developed on the ITM often become over heated and/or dried. The inventors have found that over drying leads at times to undesirable image back transfer from the blanket to the photoconductive surface. In addition, the inventors have found that over drying along the ITM circumference may negatively effect first and second transfer performance of the different separations. For example, bad first transfer from the photoconductive surface to the blanket may occur due to over drying of the blanket surface during null cycles. Also, bad second transfer from the blanket to the substrate may occur due to over drying of the ink on the blanket. The inventors have found that bad second transfer may be particularly prominent when printing jobs with low percent coverage and/or small dots.

According to some embodiments of the present invention there is provided a system and method for controlling the ink drying levels of each separation and/or page in a printing job. According to some embodiments of the present invention, the ventilation system and method may adjust the drying level for each separation as a function of the order that the separations are developed on the ITM, the percent coverage of each separation, and the intended substrate on which the image is to be printed as well as other printer parameters.

According to embodiments of the present invention, the adjustment prevents non-uniformity in drying between separations of a printed image and/or prevents non-uniformity in drying between pages in a printing job.

In known high speed printing systems, pages may be printed in a time frame of between 400 milliseconds to 3.5 seconds and/or at a speed of around 2 meters/second from blanket to paper, while each separation may be transferred onto the ITM within a time frame of between 200 milliseconds to 500 milliseconds. Known ventilation systems are not configured for adjusting and/or affecting a change in the flow supply over such short periods. According to some embodiments of the present invention, there is provided a system and method for adjusting and/or affecting the ink drying level within the time frame of a printed separation and/or page so that each separation is left with an appropriate amount of imaging oil and dried to a desired level for favorable printing results.

According to some embodiments of the present invention, the ventilation system includes one or more air supply units, e.g. before and after, for supplying air flow in a printer, air knives for directing air flow to a printed image, an air flow switching unit to toggle and schedule air supply toward and away from the printed image, and a controller for controlling the toggling and scheduling of the air flow switching unit according to separation parameters and/or parameters of a substrate on which the image is to be applied. According to some embodiments of the present invention, the air flow switching unit is a high speed switching unit that can adjust the air supply applied to each separation and/or page and/or to each of the air knifes, e.g. in the case when a plurality of air knives are implemented.

According to some embodiments of the present invention, the ventilation system includes a pressurized air unit. In some exemplary embodiments, the pressurized air unit with the air knife may supply air at a speed of up to 50-60 m/sec or 40-60 m/sec at the surface of the intermediate transfer member and/or up to 110 m/sec. High air speeds of between 50-60 m/sec enable high speed drying that can be adjusted within the time frame of development of individual separations and/or individual pages of a printing job. In some exemplary embodiments, the air supply changes occur over a period between 10-40 milliseconds. According to some embodiments of the present invention, the ventilation system includes a controller to control switching the pressure air knife on and/or off within the time frame of printed separations and/or pages.

High speed drying enables drying images with high percent coverage without requiring null cycles. Reducing the number of null cycles that the printer needs and/or eliminating the need for null cycles increase the efficiency and productivity of the printer. Null cycles directly decrease the productively of the printing press since the marking engine performs idle cycles for drying instead of printing. For example, when printing on transparent plastics with white ink, two null cycles are added typically reducing the productivity of the press by around 33%.

According to some embodiments of the present invention, the controller may control one or more parameters of the ventilation system, e.g. the controller may control the toggle position of the air flow switching unit, air pressure of air supply unit, slit width of the air knives and angle of the air knives. In some exemplary embodiments, the parameters may be controlled and adjusted before each printing job according to coverage, e.g. coverage per separation and media information which may be loaded with a job. In some exemplary embodiments e.g. in jobs including significant differences between separations, the parameters may be controlled during printing the same job and can be changed between the separations using for example a pre-defined algorithm. In some exemplary embodiments, the changes in the air supply parameters occur between printed pages and/or separations.

According to some embodiments of the present invention, the controller may schedule the air flow switching unit to provide less air to a first printed separation as compared to a final printed separation. Providing relatively less air to earlier printed separations as compared to later printed separations may facilitate achieving an even drying level for the different separation prior to printing the image on the substrate. Separations that remain on the intermediate transfer member for relatively longer time period require less active drying with air knives as compared to separations that remain the intermediate transfer member for relatively less time.

According to some embodiments of the present invention, the controller may schedule the air flow switching unit to provide less air flow to an image with low percent coverage as compared to an image with high percent coverage.

According to some embodiments of the present invention, the controller may schedule the air flow switching unit to provide less air flow to an image that is to be printed on a relatively high absorbent material as compared to an image that is to be printed on a relatively low absorbent material.

An aspect of some embodiments of the present invention is the provision of a ventilation system and method for drying each separation and/or image developed on an ITM to a desired level.

According to an aspect of some embodiments of the present invention there is provided a system for adjusting air supply applied to evaporate carrier liquid during a one shot process printing job, comprising at least one air supply unit; at least one air knife unit configured for directing air toward at least a separation of the image, wherein each separation includes a single color of a plurality of colors used to form the full colored image; and a controller configured for adjusting at least one air supply parameter between separations.

Optionally, the controller is configured for adjusting the at least one air supply parameter per the separation of the image.

Optionally, the at least one air knife unit is configured for directing air toward an intermediate transfer member of the printer.

Optionally, the image is transferred at a first transfer to the intermediate transfer member and at a second transfer from the intermediate transfer member to the substrate, and wherein the at least one air knife unit includes an air knife unit positioned substantially directly after the first transfer and an air knife unit positioned substantially right before the second transfer.

Optionally, the system comprises an air switching unit configured for toggling air either towards or away from the at least one air knife unit.

Optionally, the air switching unit comprises a rotation leaf attached to a rotary solenoid.

Optionally, the rotation leaf, in response to the toggling, is configured to alternate between sealing an air opening diverting air toward the at least one air knife unit and sealing an air opening diverting air away from the at least one air knife unit.

Optionally, the controller controls rotation of the rotary solenoid between two toggle states.

Optionally, the controller is configured for supplying less air to a first separation of the image as compared to a final separation of the image.

Optionally, the controller is configured for supplying less air to a low percent coverage image as compared to a high percent coverage image.

Optionally, the at least one air supply parameter is a time period of ventilation applied per separation.

Optionally, the at least one air supply unit is a compressor.

Optionally, the at least one air supply unit and the at least one air knife unit supplies air flow at a speed between 40-110 m/sec.

Optionally, the at least one air knife has a slit width ranging between 30-110 microns Optionally, the at least one parameter includes at least one of air pressure, air knife slit width, air knife angle.

Optionally, the at least one parameter is defined based on a percent coverage the separation.

Optionally, the at least one parameter is defined based on a substrate upon which the image is to be printed.

Optionally, the at least one parameter is defined based on information loaded with a printing job.

Optionally, the at least one parameter is adjusted based on temperature reading during printing.

Optionally, the controller is configured to dry the image between a first and second transfer of the image.

Optionally, the air supply unit and the air knife unit is configured for drying a separation with 500-600% coverage without requiring a null cycle.

According to an aspect of some embodiments of the present invention there is provided a method adjusting air supply applied to evaporate carrier liquid during a one shot process printing job, the method comprising: sensing printing parameters; and selectively adjusting the air flow directed to individual image separations during printing of a job based on the printing parameters of the image, wherein each separation includes a single color of a plurality of colors used to form the full colored image.

Optionally, the image is an image of a single separation.

Optionally, the air flow is directed toward an intermediate transfer member.

Optionally, the air flow is directed toward the feed side of the intermediate transfer member and the exit side of the intermediate transfer member.

Optionally, the method comprises supplying less air to a first separation of the image as compared to a final separation of the image.

Optionally, the method comprises supplying less air to a low percent coverage.

Optionally, the method comprises adjusting a time period of ventilation applied to the image during printing.

Optionally, the method comprises adjusting the pressure of the air flow during printing.

Optionally, the method comprises supplying air flow at a speed between 40-110 m/sec.

Optionally, air flow is directed by an air knife.

Optionally, the method comprises adjusting at least one of slit width and slit angle of the air knife during printing.

Optionally, the parameters are defined based on a percent coverage of the image.

Optionally, the parameter is defined based on a substrate upon which the image is to be printed.

Optionally, the sensing is performed at the start of a printing job.

Optionally, the printing parameters include temperature readings during printing.

Optionally, the method comprises drying the image between a first and second transfer of the image without applying a null cycle.

Optionally, the image is a 500-600% coverage image.

Optionally, the method comprises adjusting the printing parameters per page of a printing job.

For purposes of better understanding some embodiments of the present invention as illustrated in FIGS. 2-8 of the drawings, reference is first made to the construction and operation of an electro-photography printing device as illustrated in FIG. 1. According to some embodiments of the present invention, an LEP printer 10 includes a printer housing 12 having installed therein a photoconductor drum 20 having a photoconductor surface 22, a charging device 30, an exposure device 40, a development device 50, an image transfer device and/or ITM 60, and a cleaning station 70.

Charging device 30 charges photoconductor surface 22 on drum 20 to a predetermined electric potential (typically +/−500 to 1000 V). Exposure device 40 forms an electrostatic latent image on the photoconductor surface 22 by scanning a light beam (such as a laser) according to the image to be printed onto the photoconductor surface 22. Development device 50 supplies development liquid, which may be a mixture of solid toner and imaging oil, to photoconductor surface 22 to adhere the toner to the portion of photoconductor surface 22 where the electrostatic latent image is formed, thereby forming a visible toner image on photoconductor surface 22. Development device 50 may supply various colors of toner corresponding to the color images exposed by exposure device 40. Image transfer device 60 includes an intermediate transfer roller 62 in contact with photoconductor surface 22, and a fixation or impression roller 64 in contact with transfer roller 62. As transfer roller 62 is brought into contact with photoconductor surface 22, the image is transferred from photoconductor surface 22 to transfer roller 62, e.g. the ITM. A printing sheet 66 or other substrate is fed between transfer roller 62 and impression roller 64 to transfer the image from transfer roller 62 to printing sheet 66. Impression roller 64 fuses the toner image to printing sheet 66 by the application of heat and/or pressure. A ventilation system 67 including one or more fans connected to air knives are typically located along the ITM circumference and blow out air towards the printed image on the blanket. In one exemplary embodiment, the ventilation system includes two fans located along the circumference of transfer roller 62, e.g. one on the feed side and one on the exit side of the transfer roller. The fans are activated during printing to dry the image on the transfer roller.

Figure 2:
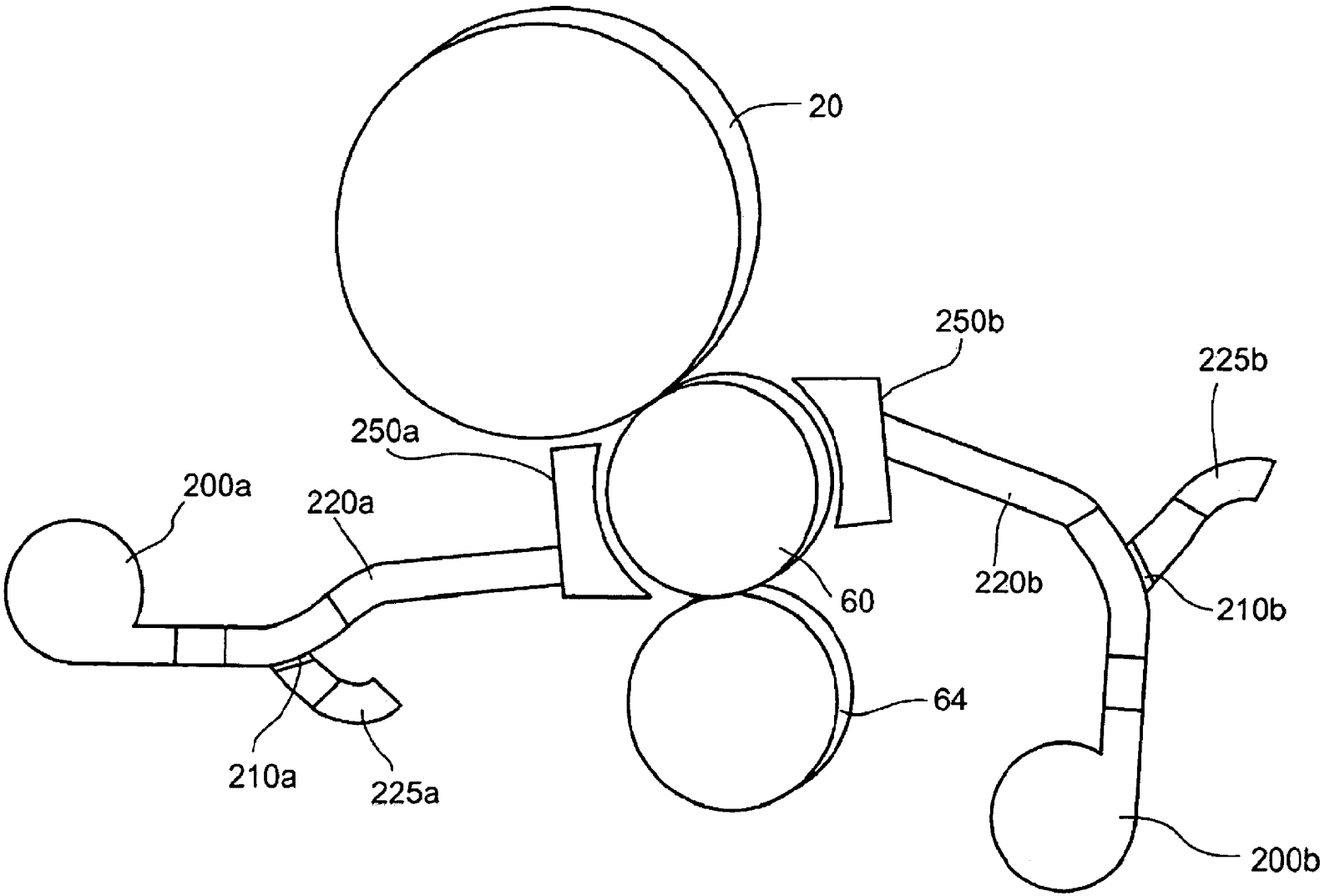
FIG. 2 is an exemplary schematic illustration of a ventilation system for an ITM of a liquid electro-photography printing device according to some embodiments of the present invention.

Reference is now made to FIG. 2 showing an exemplary schematic illustration of a ventilation system for an ITM of a liquid electro-photography printing device according to some embodiments of the present invention. According to embodiments of the present invention, the ventilation system includes fan 200A and fan 200B located along the circumference of ITM 60. Fan 200A is located at the feed side, e.g. blanket feed fan and fan 200B is located at the exit side, e.g. blanket exit fan. Fans 200A and 200B are connected to their respective air knives 250A and 250B via channel 220A and 220B. In one exemplary embodiment, each of channels 220A and 220B may include a plurality of openings toward the blanket, e.g. plurality of openings dispersed along the circumference of the ITM.

Alternatively, air from fans 200A and 200B may be diverted away from the blanket through channels 225A and 225B. In respective channels 225A and 225B, air switching units 210A and 210B serve to toggle between two positions and/or states to divert air from channel 220A to 225A or from channel 220B to 225B. According to some embodiments of the present invention, the position of the air switching units 210A and 210B may be controlled to toggle and to schedule air supply directed toward the blanket according to printed characteristic separation and/or application.

Figure 3A:
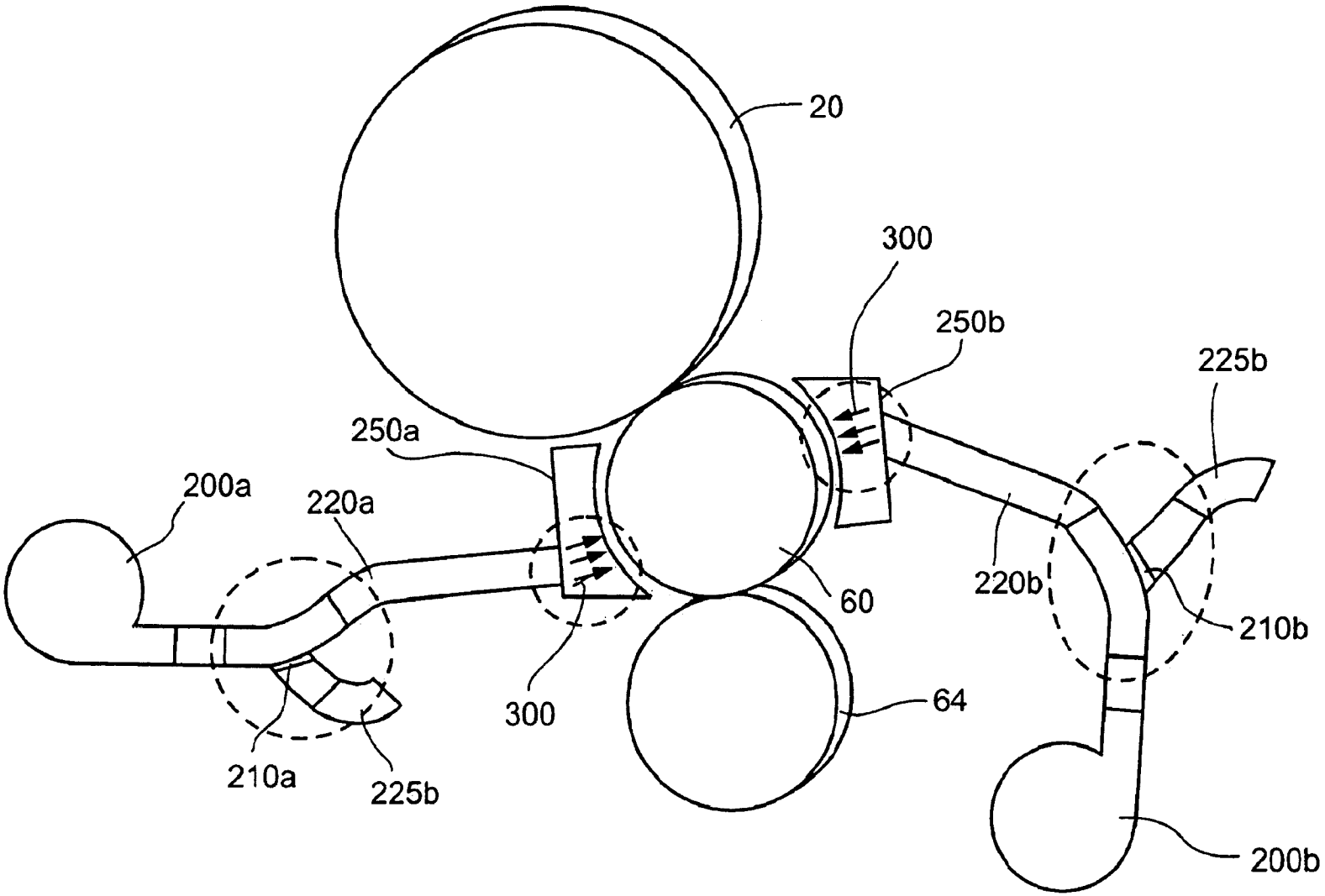
FIG. 3A is an exemplary schematic illustration of the ventilation system showing air flow directed toward the air knives according to some embodiments of the present invention.
Figure 3B:
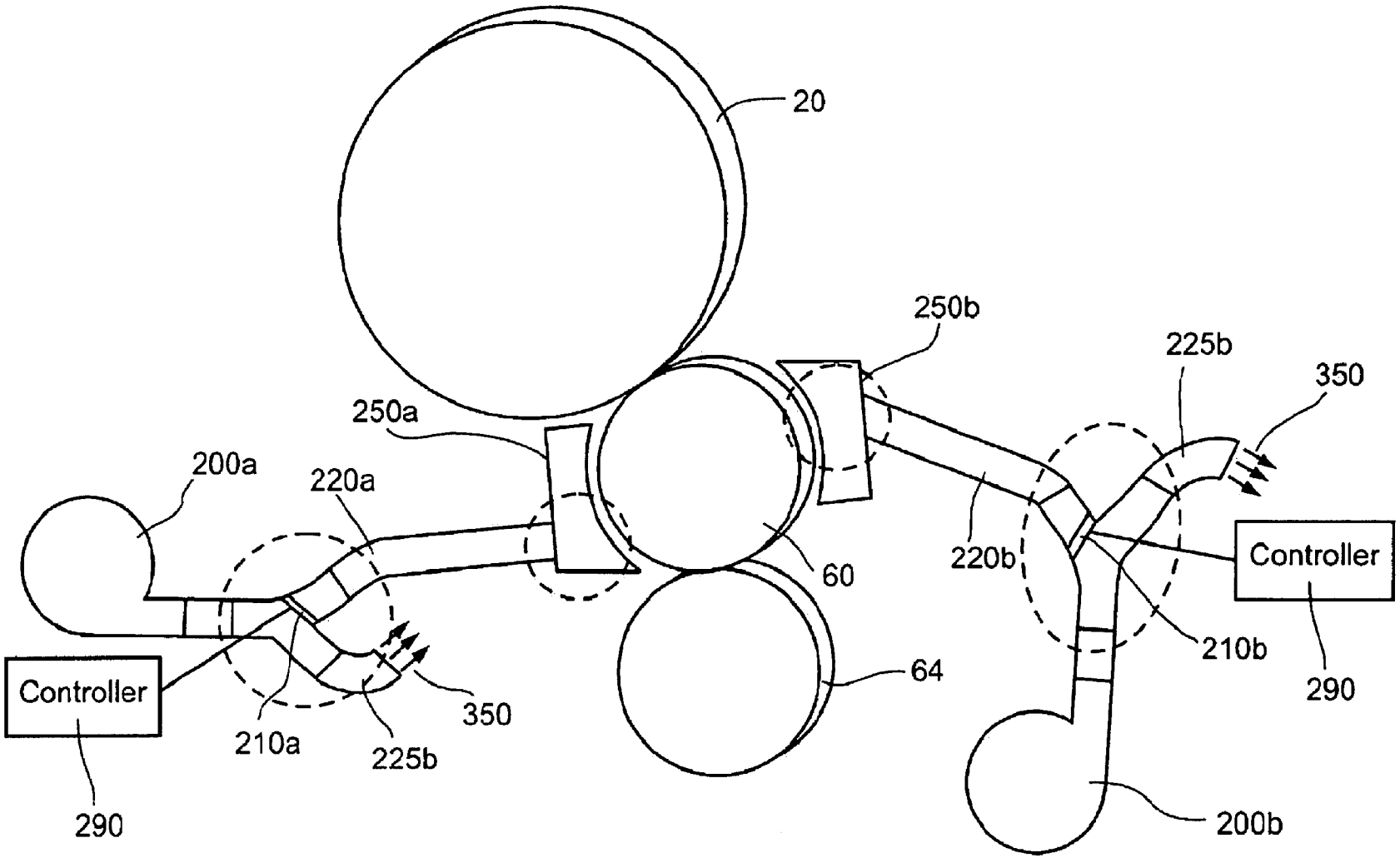
FIG. 3B is an exemplary schematic illustration of the ventilation system showing air flow diverted away from the ITM according to some embodiments of the present invention.

Reference is now made to FIGS. 3A and 3B showing exemplary schematic illustrations of air flow through the ventilation system directed either toward or away from the air knives according to some embodiments of the present invention. According to some embodiments of the present invention, over a period of time where an air supply, e.g. an air jet is required to dry a separation on an ITM, air switching unit 210A and 210B direct air 300 from blower 200A and 200B toward air knives 250A and 250B. In this state, e.g. the activated air knife state, as shown in FIG. 3A, the air knife units supply air toward the ITM blanket to cool, dry and ventilate the blanket. As soon as an air jet is not required, e.g. the required ventilation is achieved, air switching units 210A and 210B toggle to a second state, e.g. a deactivated air knife state, to block the air towards the air knives and divert the air through channel 225A and 225B. In the state illustrated in FIG. 3B, the air knives are disabled. The toggle position of air switching units may be controlled by controller 290. Controller 290 may be a dedicated controller and/or circuitry with controlling functionality.

According to some embodiments of the present invention, air switching units 210A and 210B are controlled together as one unit and toggle simultaneously between the two states. According to other embodiments of the present invention, a lag between toggling of air switching units 210A and 210B, e.g. a lag based on the position of each of the air knife units is programmed. According to still other embodiments, air switching units 210A and 210B may be controlled separately. For example, depending on the drying level required and the parameters of the job, only one air knife unit may be activated, e.g. for relatively low percent coverage images and/or separations. Alternatively both air knife units may be used for some separations while only one air knife unit may be used for other separations. In one exemplary embodiment, the air knife used may be selected based on its position and the printing parameters of the job. According to some embodiments of the present invention, the number of air knife units activated and the timing of each air knife unit is a function of the characteristics of the separation and/or application. According to some embodiments of the present invention, more or less than two air knife units may be included in the ventilation system, e.g. one air knife unit or 3 or more air knife units may be included.

Figure 4B:
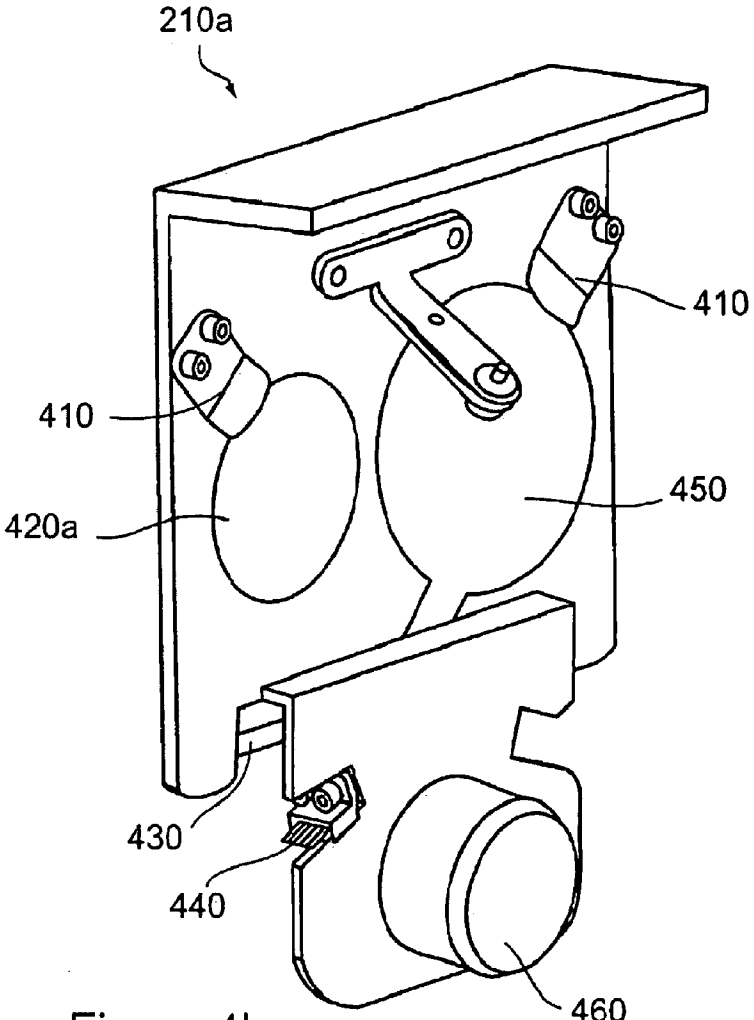
FIGS. 4A and 4B are exemplary schematic illustration of the air switching unit according to some embodiments of the present invention.
Figure 4A:
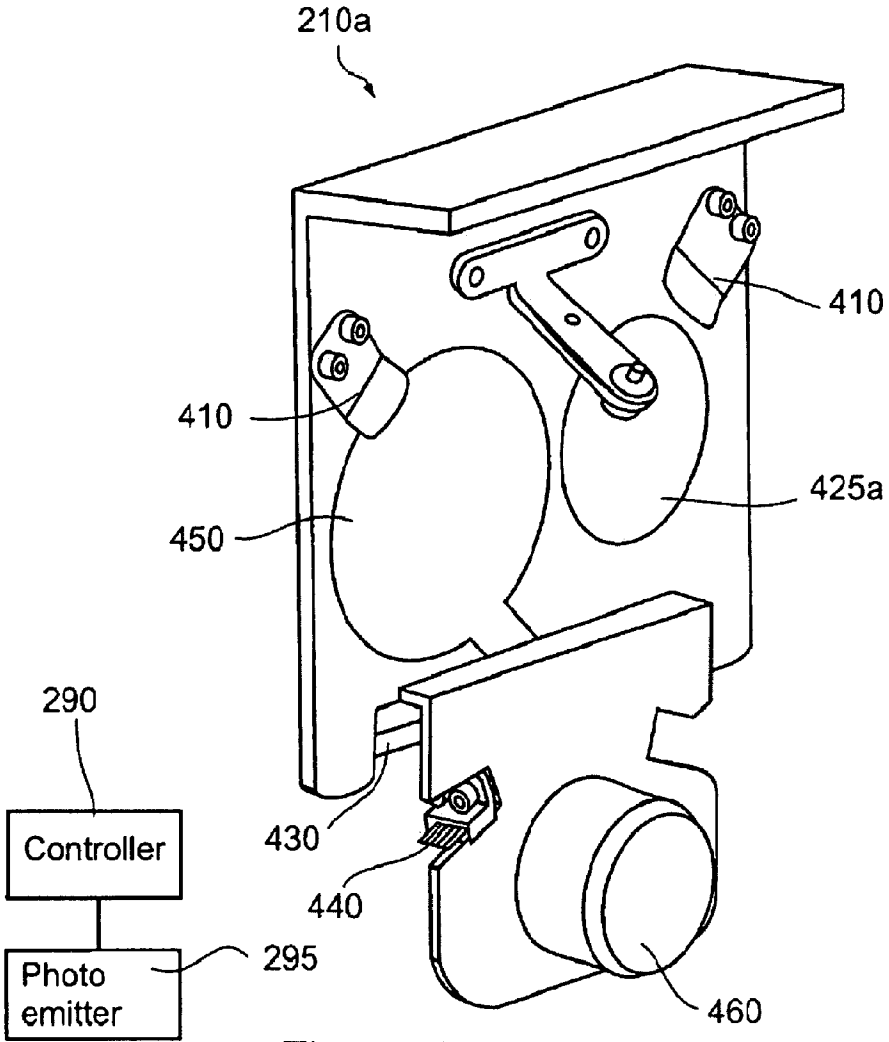

Reference is now made to FIGS. 4A and 4B showing an exemplary schematic illustration of the air switching unit according to some embodiments of the present invention. According to some exemplary embodiments, air switching unit 210A is operated by a rotary solenoid 460 that serves to pivot a rotation leaf 450 between two air openings 420A and 425A each diverting air toward their respective channels 220A and 225A (FIG. 3). Flat springs 410 may secure rotation leaf 450 over one of the air openings and aid in sealing the air opening blocked by the rotation leaf. A returning spring 430 may be included to add stiffness to the air switching unit. Photo detector 440 may be included to control operation of solenoid 460. Based on detection of a light signal, solenoid 460 may rotate between one of two states. Controller 290 with photo emitter 295 may activate the solenoid on demand by transmitting a light signal toward photo detector 440. According to some embodiments of the present invention, air switching unit 210 may enable toggling between two states, e.g. activated air knife state and deactivated air knife state, almost instantaneously, enable adapting the air supply to each separation printed, and provide accurate control of the drying level at each stage of printing. According to embodiments of the present invention, air switching unit 210B may identical and/or function similarly to air switching unit 210.

Figure 5:
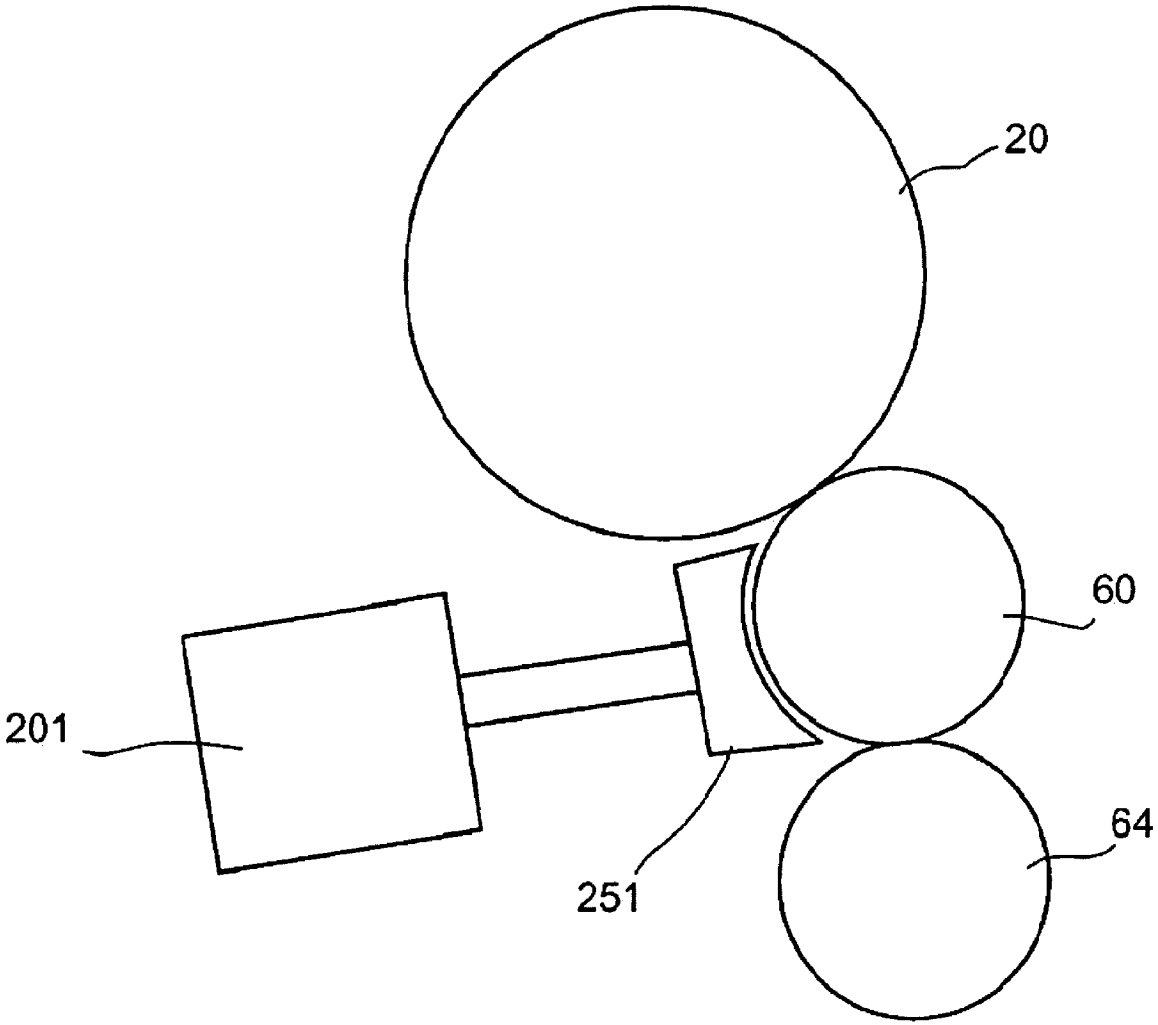
FIG. 5 is an exemplary schematic illustration of a ventilation system applied to an ITM of a liquid electro-photography printing device using pressurized air according to some embodiments of the present invention.

Reference is now made to FIG. 5 showing an exemplary schematic illustration of a ventilation system applied to an ITM of a liquid electro-photography printing device using pressurized air according to some embodiments of the present invention. According to some embodiments of the present invention, a pressure air knife with controlled high pressure air supply for evacuation of imaging oil from an ITM blanket may be used in place of a blower, e.g. low pressure air supply, with an air slit and/or a low pressure air knife. In one exemplary embodiment, a pressurized air supply unit 201 may direct air through pressure air knife 251 toward an ITM drum 60. According to some embodiments of the present invention, pressure air knife 251 may supply air at a speed of up to 50-60 m/sec as compared to current speeds of about 10 m/s. Air flow aimed at the blanket surface of ITM 60 at such high speed may serve to disturb a laminar boundary layer near the surface causing turbulent air flow. The inventors have found that the turbulent air flow created by the pressure air knives may significantly increase the evaporation rate of the imaging oil in addition to supplying a large amount of fresh air for evacuation of the vapors created as a result of the evaporation. This significantly increases the amount of imaging oil and/or carrier that can be evacuated from the blanket and enables printing of heavy images, e.g. images of up to approximately 500-600% coverage without introducing drying null cycles. According to embodiments of the present invention, the pressure air knife may be turned on and/or off substantially instantaneously and/or over a short time period so that changes in air supply may be made between pages and/or separations.

In some exemplary embodiments the air supply source is a compressor. A compressor in some cases may be more efficient and air saving as opposed to a blower.

Figure 6:
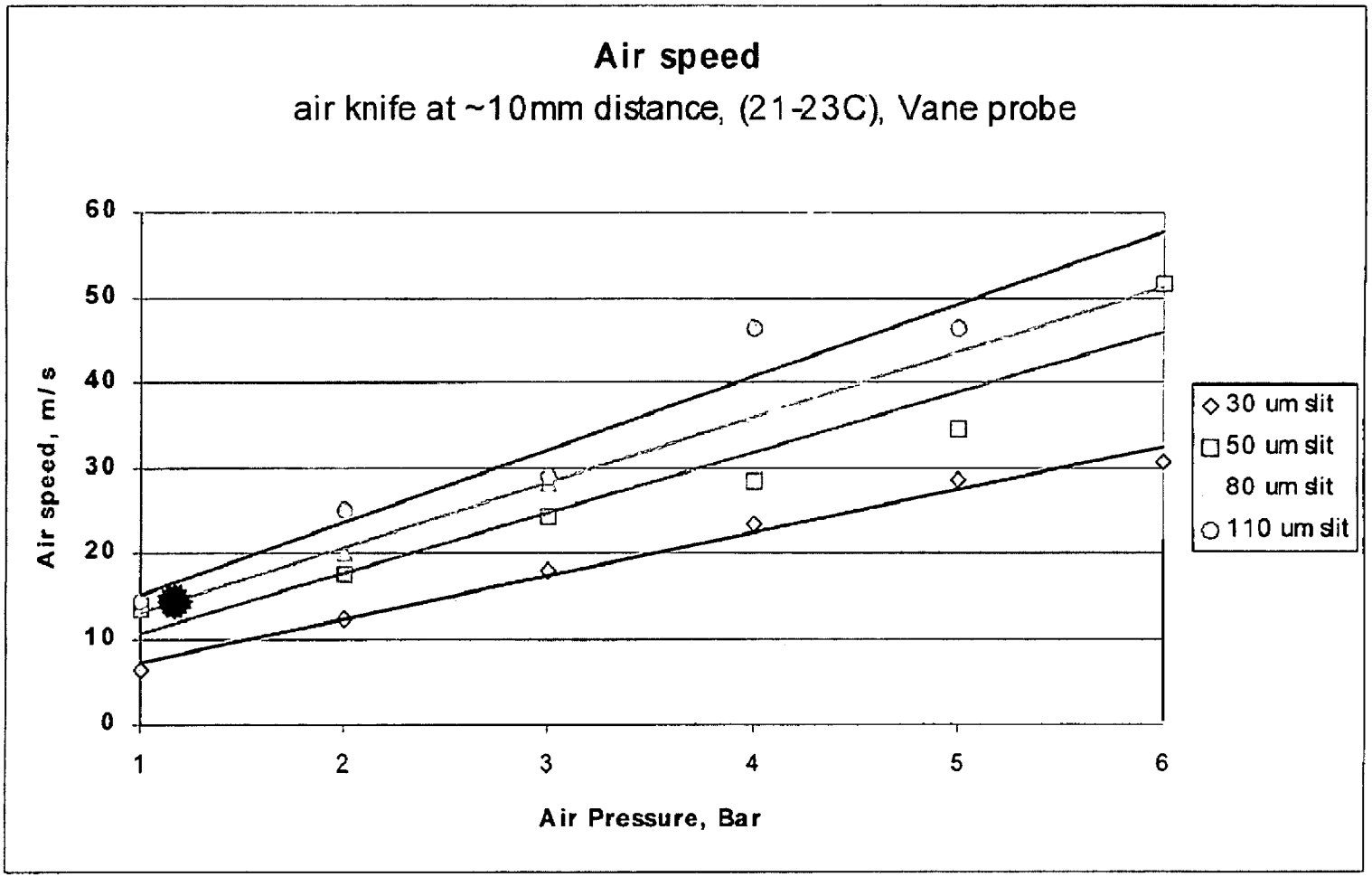
FIG. 6 is a graph plotting a relationship between air pressure and speed for different slit widths of pressure air knives according to some embodiments of the present invention.

Reference is now made to FIG. 6 showing a graph plotting a relationship between air pressure and speed for different slit width of pressure air knives according to some embodiments of the present invention. According to some embodiments of the present invention, the amount and speed of the supplied air may be adjusted by changing the pressure, slit width and/or angle of air attack to suit the image coverage and/or substrate used. In an exemplary embodiment, the inventors have found that the air speed through an air knife may be increased to approximately 50-60 m/sec and/or between about 50-100 m/s or 40-110 m/s by increasing the pressure of the air supply, e.g. to approximately 5-6 Bars and using air knife slits of between approximately 50-100 microns. According to some embodiments of the present invention, one or more slits may be implemented at desired directions. In some exemplary embodiments, the slits are directed at an approximately perpendicular direction in relation to the process direction, e.g. between substantially 75 to 90 degrees.

According to some embodiments of the present invention, air supply parameters may be controlled and adjusted before each printing job as a function of coverage and substrate information that may be loaded with the job. According to some embodiments, when very different coverage is required between separation, air supply parameters may be controlled during printing the same job and may be changed between separations according to a defined algorithm.

Figure 7A:
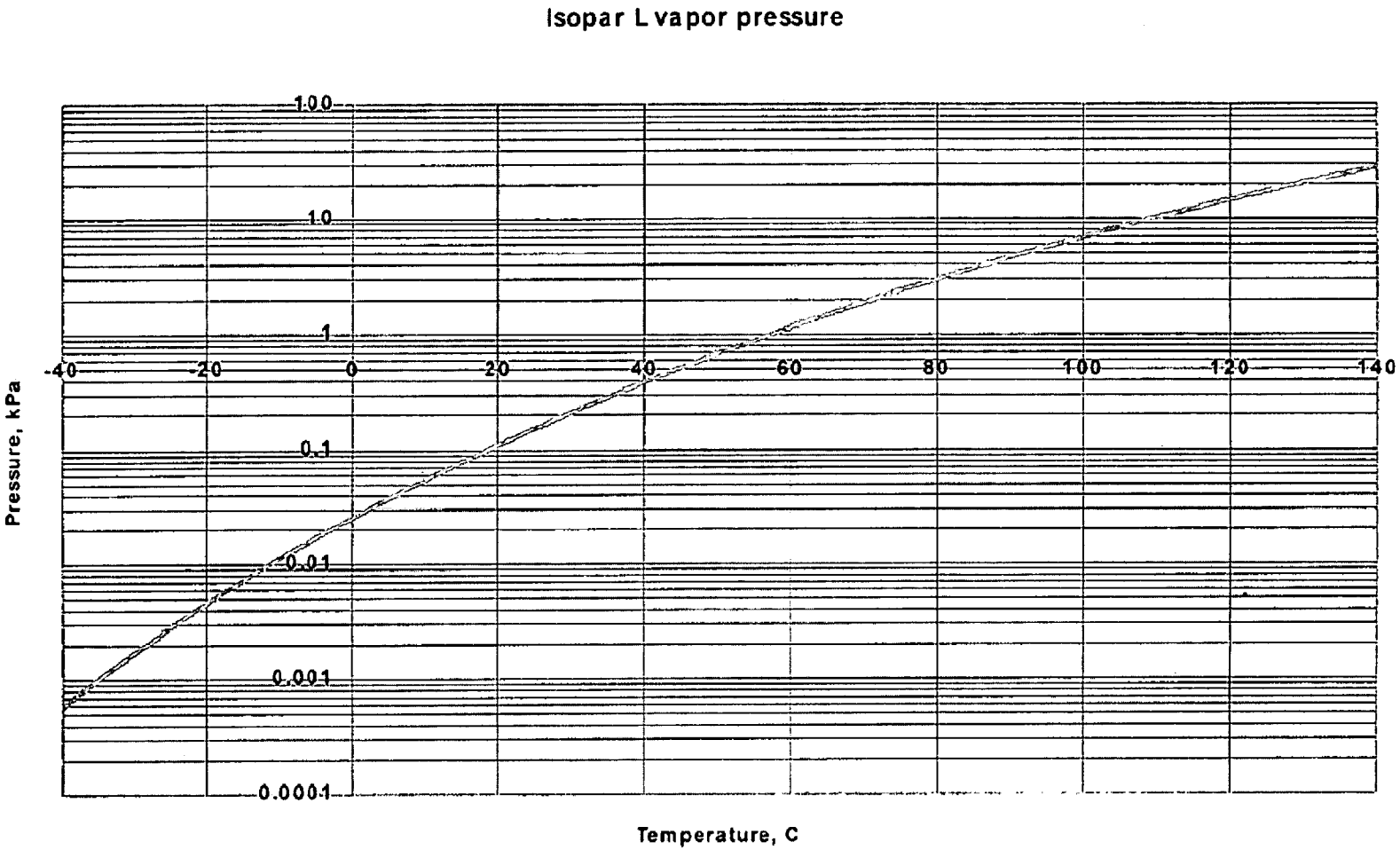
FIGS. 7A and 7B are graphs of vapor pressure and content respectfully as a function of temperature according to embodiments of the present invention.
Figure 7B:
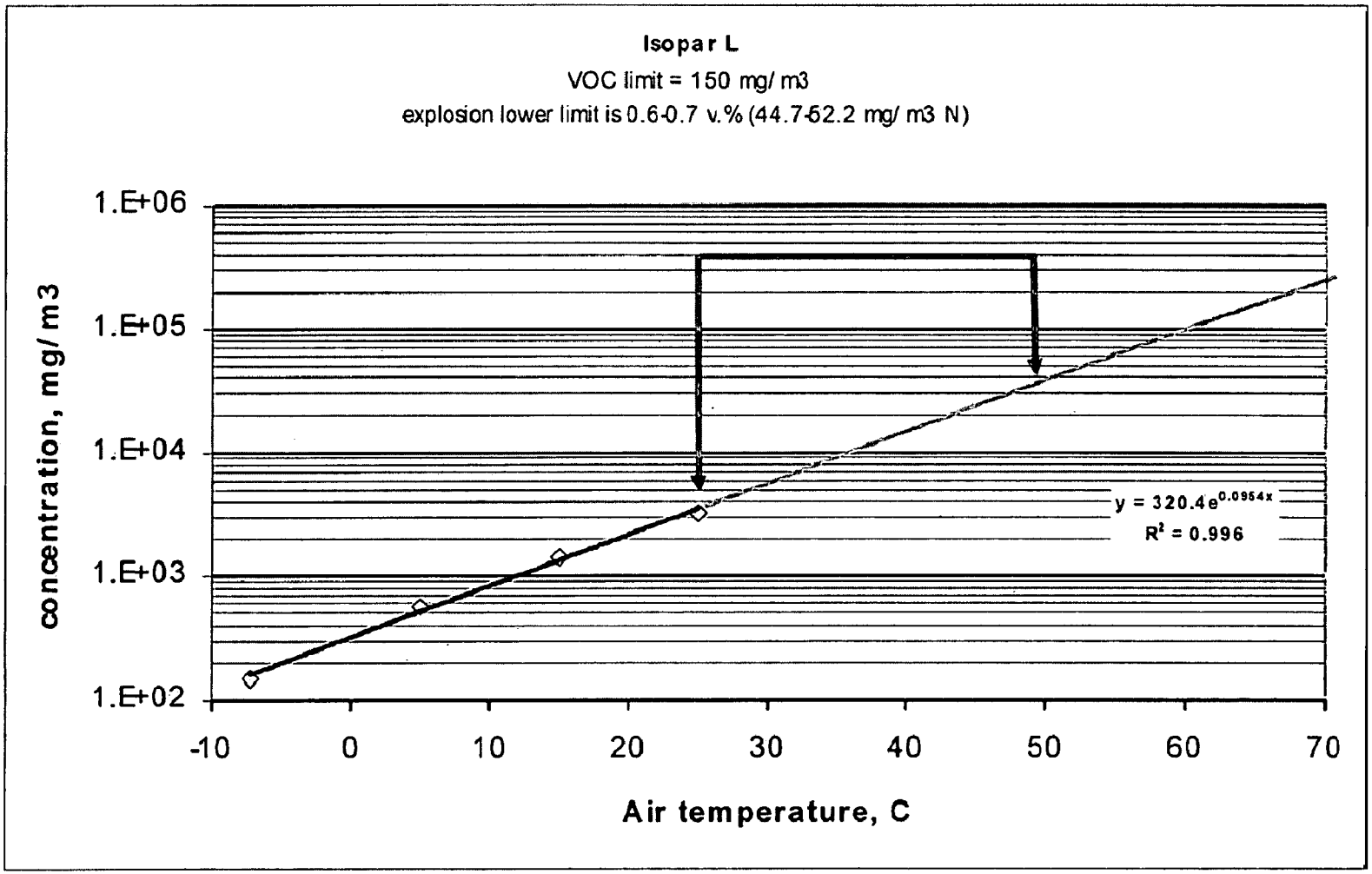

Reference is now made to FIGS. 7A and 7B showing graphs of vapor pressure of carrier liquid and content as a function of temperature according to embodiments of the present invention. Vapor pressure and the vapor content in the air are affected by cooling of the air flow from the ventilation system. According to some embodiments of the present invention, a defined algorithm to control air supply may include ITM temperature compensation to counteract the cooling effect of the air flow from the ventilation system. According to some embodiments of the present invention, the ventilation system may include an incoming air heating system to stabilize and/or control temperature and humidity levels in the supplied air.

According to some embodiments of the present invention, the ventilation system may provide different levels of ventilation for each separation and/or for each page. Customizing the amount of ventilation provided for each separation facilitates properly drying each separation. According to some embodiments of the present invention, over drying of a separation may lead to improper small dot transfer, while under drying a separation may lead to wetness and/or cracks on the printed image. In some exemplary embodiments, the ventilation system may provide a base air flow for the first separation and increase the air flow for each subsequent separation. This may prevent over drying of the first separations. In some exemplary embodiments, increasing the air flow is performed by increasing the period of time that air is directed toward the ITM, e.g. increasing and/or controlling the period of the activated air knife state. In some embodiments of the present invention, the ventilation system may be programmed to provide a short period of ventilation for the first printed separation(s) and a longer period of ventilation for the last printed separation(s). In some embodiments, the ventilation system may be programmed to provide a short period of ventilation for low image coverage, e.g. small dots, and a longer period of ventilation for high image coverage. In some exemplary embodiments, a different amount of coverage may exist between different separations and/or different pages of a printing job. According to embodiments of the present invention, the ventilation system may be controlled and/or programmed to provide different periods of ventilation for each separation and/or page of a job. According to some embodiments of the present invention, air flow for each separation and/or page may be controlled by controlling air pressure, slit width, a combination of parameters, and/or other parameters described herein.

Although the system and method has been described with regard to drying an image on an ITM, one skilled in the art will appreciate that a similar system and method may be applied to drying an image at different points of the printing cycle, e.g. prior to the first transfer and/or after the second transfer without straying for the scope of the present invention.

The term "consisting essentially of" means that the composition, method or structure may include additional ingredients, steps and/or parts, but only if the additional ingredients, steps and/or parts do not materially alter the basic and novel characteristics of the claimed composition, method or structure.

The terms "comprises", "comprising", "includes", "including", "having" and their conjugates mean "including but not limited to".

The term "consisting of means "including and limited to".

What is claimed is:

1. A system for adjusting air supply applied to evaporate carrier liquid during a one shot process printing job, comprising:

at least one air supply unit;

at least one air knife unit configured for directing air toward at least a separation of the image, wherein each separation includes a single color of a plurality of colors used to form a full colored image; and a controller configured for adjusting at least one air supply parameter between separations.

2. The system according to claim 1 wherein the controller is configured for adjusting the at least one air supply parameter per the separation of the image.

3. The system according to claim 1 wherein the image is transferred at a first transfer to an intermediate transfer member and at a second transfer from the intermediate transfer member to a substrate, and wherein the at least one air knife unit includes an air knife unit positioned substantially directly after the first transfer and an air knife unit positioned substantially right before the second transfer.

4. The system according to claim 1 comprising an air switching unit configured for toggling air either towards or away from the at least one air knife unit.

5. The system according to claim 4 wherein the air switching unit comprises a rotation leaf attached to a rotary solenoid.

6. The system according to claim 5 wherein the rotation leaf, in response to the toggling, is configured to alternate between sealing an air opening diverting air toward the at least one air knife unit and sealing an air opening diverting air away from the at least one air knife unit.

7. The system according to claim 1 wherein the at least one air supply parameter is a time period of ventilation applied per separation.

8. The system according to claim 1 wherein the at least one air supply unit is a compressor.

9. The system according to claim 1 wherein the at least one air supply unit and the at least one air knife unit supplies air flow at a speed between 40-110 m/sec.

10. The system according to claim 1 wherein the at least one air knife has a slit width ranging between 30-110 microns.

11. The system according to claim 1 wherein the at least one parameter includes at least one of air pressure, air knife slit width, air knife angle.

12. The system according to claim 1 wherein the at least one parameter is defined based on information loaded with a printing job.

13. The system according to claim 12 wherein the at least one parameter is adjusted based on temperature reading during printing.

14. The system according to claim 1 wherein the air supply unit and the air knife unit is configured for drying a separation with 500-600% coverage without requiring a null cycle.

15. A method adjusting air supply applied to evaporate carrier liquid during a one shot process printing job, the method comprising:

sensing printing parameters; and selectively adjusting the air flow directed to individual image separations during printing of a job based on the printing parameters of the image, wherein each separation includes a single color of a plurality of colors used to form the full colored image.

16. The method according to claim 15 wherein the image is an image of a single separation.

17. The method according to claim 15 wherein the air flow is directed toward an intermediate transfer member.

18. The method according to claim 15 comprising supplying less air to a first separation of the image as compared to a final separation of the image.

19. The method according to claim 15 comprising supplying less air to a low percent coverage image as compared to a high percent coverage image.

20. The method according to claim 15 comprising adjusting a time period of ventilation applied to the image during printing.

* * * * *